United States Patent [19]

Moore

[11] Patent Number: 5,000,110

[45] Date of Patent: Mar. 19, 1991

[54] TOWLINE DEPRESSOR

[76] Inventor: Barry B. Moore, Kingston Rd., Danville, N.H. 03819

[21] Appl. No.: 413,169

[22] Filed: Sep. 27, 1989

[51] Int. Cl.[5] ..... B63G 8/18

[52] U.S. Cl. ..... 114/245; 114/244; 114/331

[58] Field of Search ..... 114/242, 244, 245, 253, 114/254, 121, 122, 126, 312, 330, 331, 332, 39.1; D12/308, 317; 181/110; 367;154/106, 153; 43/43.1, 43.13

[56] References Cited

U.S. PATENT DOCUMENTS

| | | | |
|---|---|---|---|
| 2,561,539 | 7/1951 | Seward | 114/126 |
| 3,137,264 | 6/1964 | Brainard | 114/244 |
| 3,260,232 | 7/1966 | Douglas | 114/245 |
| 3,469,551 | 9/1969 | Lefebvre | 114/242 |
| 4,019,453 | 4/1977 | Boswell | 114/245 |
| 4,549,499 | 10/1985 | Huffhines | 114/244 |
| 4,729,333 | 3/1988 | Kirby | 114/253 |

*Primary Examiner*—Joseph F. Peters, Jr.
*Assistant Examiner*—Clifford T. Bartz
*Attorney, Agent, or Firm*—Hamilton, Brook, Smith & Reynolds

[57] ABSTRACT

A towline depressor (2) having forward and rearward ends with a main body portion (4) at the forward end. Wings (6) and (8) extend from the body with stabilizing fins (10) and (12) depending from the wings. A dorsal fin (14) having holes (16), (18) and (20) extends from the top center of the body for attaching the depressor to a towline. The holes permit attaching the towline at varying points relative to the center of gravity of the depressor.

18 Claims, 4 Drawing Sheets

TOWLINE DEPRESSOR

FIELD OF THE INVENTION

This invention relates to hydrodynamic equipment in general and, more specifically, to non-planar bodies which are employed to maintain an object which is being towed through water, at a predetermined depth.

BACKGROUND OF THE INVENTION

Such bodies are sometimes called "towed underwater instruments" or, when employed as fishing aids, as "towline depressors". They are used with downriggers in underwater research activity wherein scientific instruments such as seismic recording devices are towed, as well as in deep trolling for fish.

One objective of the invention is to troll or drag an object through the water constantly at a predetermined depth below the surface but above the bottom. In the research fields the object being towed is generally a measuring instrument and in fishing it is a lure or bait.

Traditionally, constant depth trolling or towing has been maintained by towing a sphere or ball which is usually made of lead. Because of its symmetry surface the lead ball provides no net "lifting" effect but is employed because of its extremely high density and its low drag coefficient.

In this specification it should be understood that "lifting" or "lifting effect" really means "sinking" or "sinking effect", that is, negative lifting or causing the object being towed to stay below the surface.

One of the negatives involved in using a lead ball is its extreme weight. Another negative is the drag of the sphere through the water which reduces its effectiveness at depths where actually it would be desired to tow the instrument or bait. The drag on the ball is a direct function of its speed through the water and the operating depth is also a directed function of speed at which the ball is towed. When not in motion, the ball hangs vertically downward at the full depth of its towline and as towing speed increases the ball moves upwardly into a position directly behind the boat or vehicle which is towing it. The higher the towing speed the higher the ball rides in the water. This is a disadvantage.

This action may be likened to the way a lighter than air balloon acts when tethered by a string. When there is no wind the balloon rises vertically (i.e., at ninety degrees to the ground). Its height is limited only by the length of its string. As the wind begins to blow, the angle of the string becomes less than ninety degrees and the balloon moves closer to the ground, still limited by its string which now is likened to a hypotenuse.

It is an object of this invention to produce a towline depressor which, through its hydrodynamic design will, when towed through water, remain at a substantially constant depth throughout a range of towing speeds.

Another object of this invention is to produce a towline depressor the towing depth of which may be determined solely by the length of the towline through a range of towing speeds.

SUMMARY OF THE INVENTION

Invention resides in a towline depressor which has a main body portion located at its forward end. There are a pair of wings extending laterally from the main body portion and a stablizing fin depends from each wing at the rearward portion of the depressor. A towline attaching dorsal fin extends upwardly from the top center of the main body portion.

The dorsal fin has a series of spaced holes for attaching a towline. The hole which is nearest to the forward end of the depressor is located forward of the center of gravity of the depressor. The center of gravity of the depressor itself is located between the hole nearest to the forward end and the hole which is next adjacent to it. The center of gravity of the depressor is also closer to the forward end than the theoretical center of pressure.

Various dimentional relationships exist relative to the overall size of the depressor and location of the towline attaching holes. When the overall length of the depressor is 13 units of length, the hole nearest to the forward end is spaced approximately 2.625 units of length from the front end and with this same size depressor, the hole next adjacent to the hole nearest to the forward end is space approximately 3.25 units of length from the forward end. A third hole is spaced 4.125 units of length from the forward end. The center of gravity is spaced approximately 3 units of length from the forward end, i.e., between the first and second holes.

The above and other features of the invention, including various novel details of construction and combinations of parts, will now be more particularly described with reference to the accompanying drawings and pointed out in the claims. It will be understood that the particular towline depressor embodying the invention is shown by way of illustration only and not as a limitation of the invention. The principals and features of this invention may be employed in varied and numerous embodiments without departing from the scope of the invention.

DETAILED DESCRIPTION OF THE INVENTION

Figure 1:
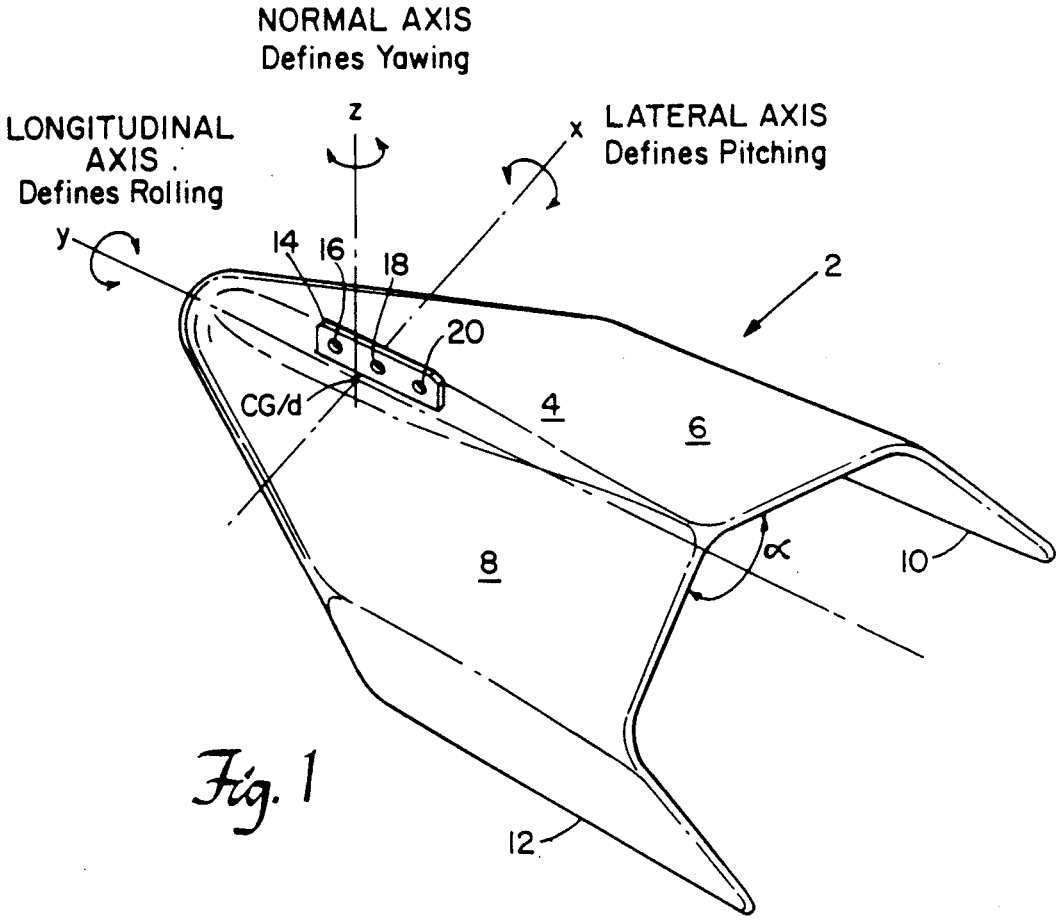
FIG. 1 is a perspective view of a towline depressor embodying features of the present invention.
Figure 2:
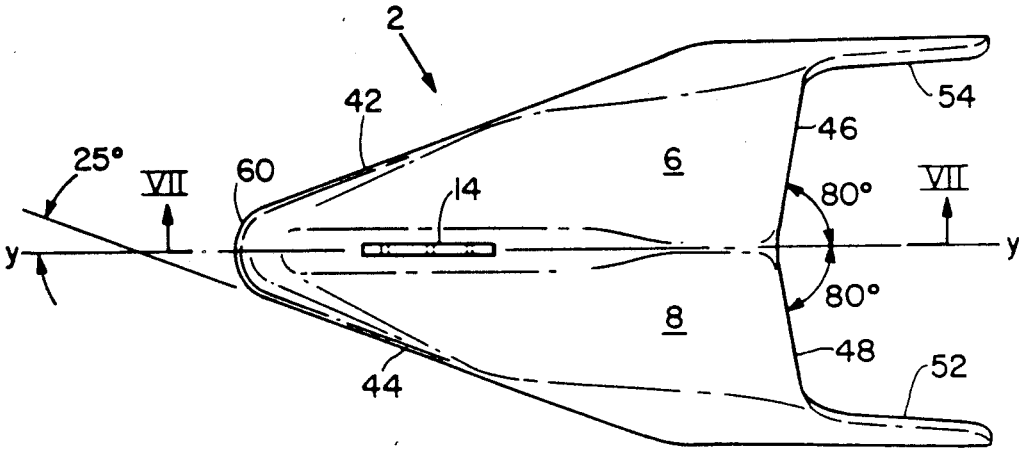
FIG. 2 is a plan view.
Figure 3:
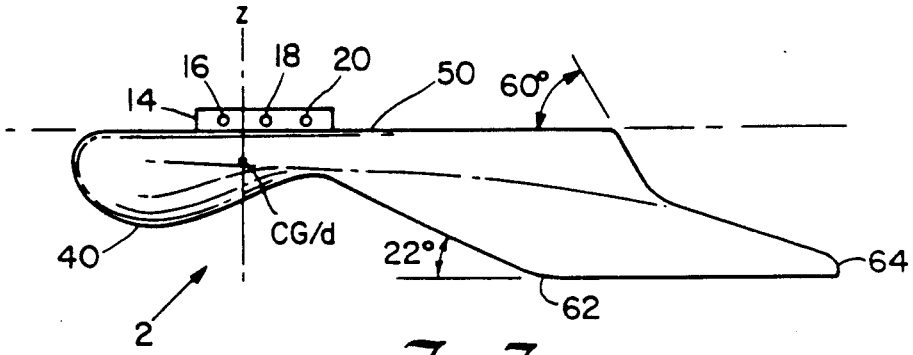
FIG. 3 is a side view.

Referring to FIG. 1, a towline depressor generally indicated 2, embodying the features of my present invention will be seen in perspective. While it is similar in external appearance to a towline depressor disclosed in my co-pending design patent application Ser. No. 895,748 filed Aug. 12, 1986, now U.S. Pat. Des. 308,558, issued Jun. 5, 1990, its fluid dynamic properties, size and weight differ substantially from the prior device.

Figure 4:
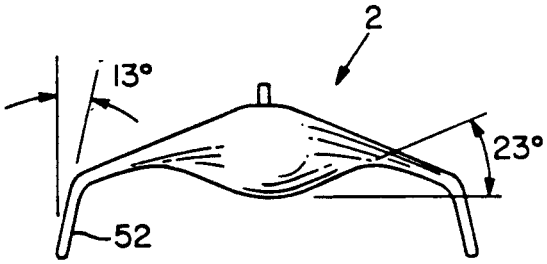
FIG. 4 is a front view.
Figure 5:
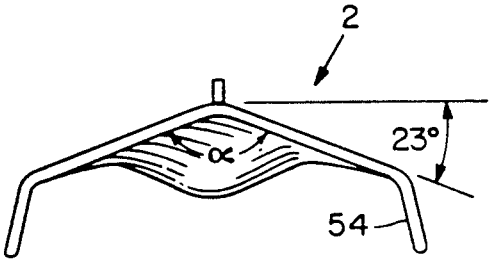
FIG. 5 is a rear view.
Figure 6:
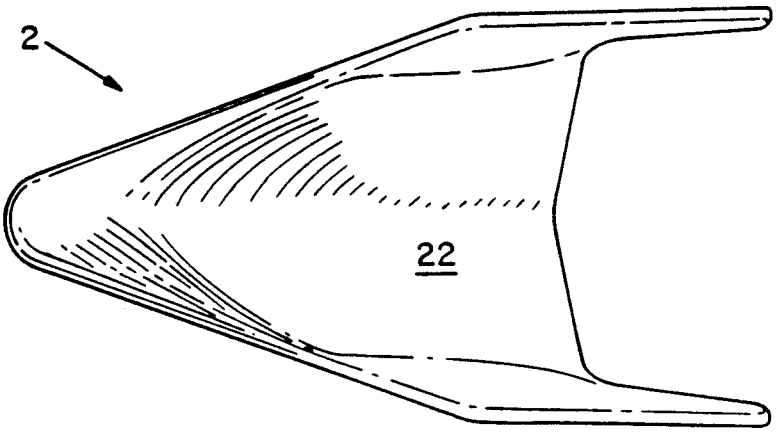
FIG. 6 is a bottom view thereof.

The towline depressor is also seen in detail in FIGS. 2 through 7. It has a main body portion 4, a pair of laterally extending wings 6 and 8 which come together centrally of the body 4 at a negative dihedral angle $\alpha$ (see FIG. 5). Depending from the wings 6 and 8 are stabilizing fins 10 an 12, respectively. A towline attaching dorsal fin 14 having holes 16, 18 and 20, extends upwardly from the top center of the main body portion 4. The underside of the body portion 4 together with the wings 6 and 8 from a concave surface 22 (FIG. 6).

Superposed on FIG. 1 are three principal axes, X,Y, and Z, intersecting at the theoretical center of gravity CG/d of the depressor, or "wing" as it is sometimes called. The X, or lateral axis passes side-to-side through the depressor 2 and it is about this axis that the depressor would pitch when towed, thus it is also known as the pitching axis. The Y axis passes from front to rear axially through the center of the depressor and is the rolling axis. The Z axis passes vertically through the depressor and defines the yawing axis.

As seen in FIGS. 7–12, located in the main body portion 4 of the depressor 2 is a shaped weight 30. The dorsal fin 14, for attaching the towline 32, is intrical with the weight 30 is made preferably of non-corrosive material, such as stainless steel. In effect, the fin, only dorsal portion which is seen, is inverted "T"-shape. The weight 30, which is of lead or other equivalent material, is cast around the top of the "T" so that only the dorsal portion 14 extends outwardly and upwardly as shown.

Figure 8:
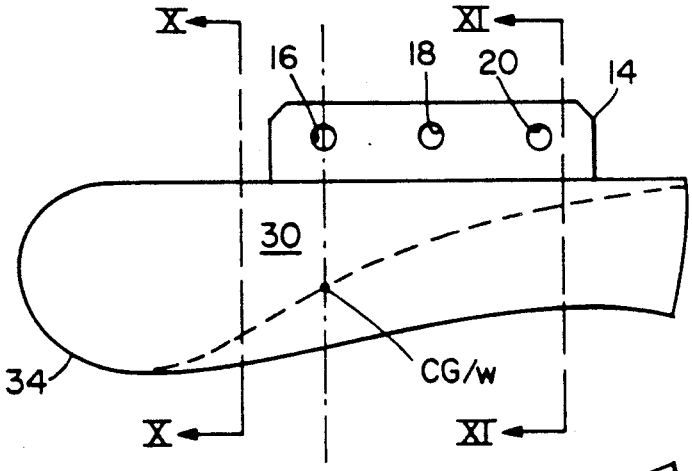
FIG. 8 is a side view of an internal weight for the depressor, but before being combined with it.
Figure 9:
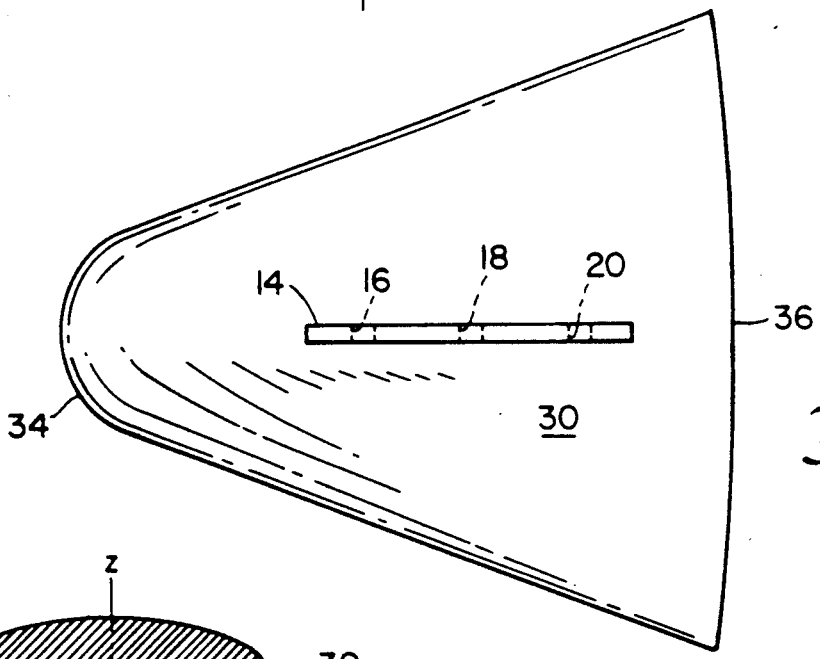
FIG. 9 is a plan view of the weight.
Figure 10:
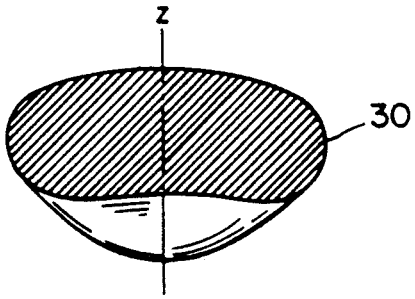
FIG. 10 is a sectional view taken along the line X—X of FIG. 8.
Figure 11:
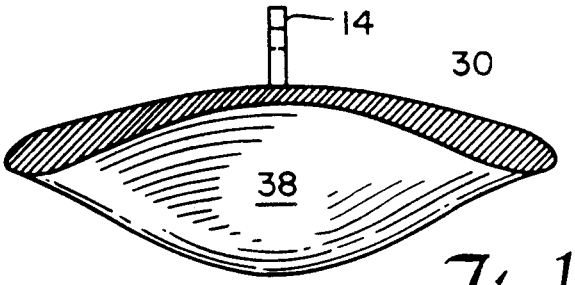
FIG. 11 is a sectional view taken along the line XI—XI on FIG. 8.
Figure 12:
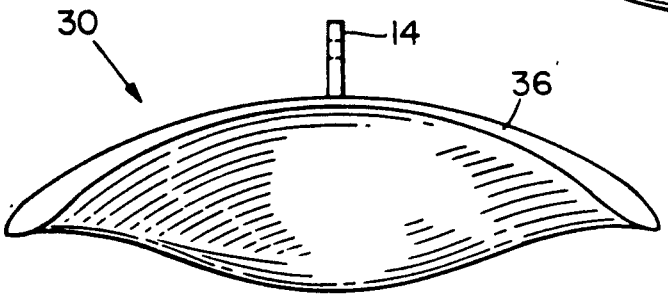
FIG. 12 is a rear view of the weight.

In plan view, as seen in FIG. 9, the weight is essentially triangular shaped having a nose 34. As viewed from the side in FIG. 8, the nose 34 will be seen to be bulbous. The weight extends toward the right, as viewed in FIGS. 8 and 9, and terminates in an edge 36, which as seen from the rear in FIG. 10, is arcuate. The undersurface is concave as seen at 38.

The weight is located within the depressor 2 by molding the plastic around the weight with the dorsal fin 14 extending upwardly and out of the plastic at the top of the depressor.

Again referring to FIGS. 2 through 6, the leading edges 42, 44 of the depressor, which in part define the bulbous front portion 40, each form an angle of approximately 25° with the longitudinal axis Y.

The trailing edges 46 and 48 each form an angle of approximately 80° with the longitudinal axis Y and are inclined downwardly and rearwardly at an angle of approximately 60° (FIG. 3) with the upper edge 50 of the body 4 and with the longitudinal axis y with which the edge 50 is parallel.

Depending from the wings (6 and 8) are a pair of stabilizing fins 52 and 54. The leading edge of the fins are inclined at an angle of approximately 22° with the upper edge 50 and the axis y. The wings (6 and 7) are shaped to the reverse dihedral angle X which is approximately 23° from the horizontal, as the X axis 5. The fins extend downwardly and outwardly, as seen in FIG. 4, at approximately 13° from a plane passing vertically through the center of the depressor 2.

As also seen in FIG. 4, the lower portion of the body slopes upwardly from the horizontal at approximately 23°.

It will be appreciated that two depressors embodying the features of the present invention may be made in many different sizes and weights, but it is the relationship of the size and weight which is important. Hereinafter, a size-weight relationship will be established in units of size and units of weight which may be increased or decreased, each proportional to the other.

The overall length of the tow depressor from the nose 60 to the trailing tips 64 of the fins 52, 54 is 13 units of length. The maximum width of the tow depressor is 7 units. The maximum vertical dimension at its highest part is 2.5 units. The vertical dimension of the bulbous nose portion is 1.5 units. The distance from the lower front of 62 of the fins 52, 54 to the trailing tips 64, is 5 units.

As stated above, there are three attaching holes 16, 18 and 20 in the dorsal fin 14 to which the towline may be attached. The leading end of the dorsal fin is approximately 2.25 units from the nose 60. The center of the first hole 16 is 2.625 units from the nose; the second hole 18 is located 3.25 units from the nose; and the third hole 20 is located 4.125 units from the nose.

The relationship of the holes 16, 18 and 20 to the center of gravity of the weight CG/w 30 (FIG. 8) and the center of gravity of the CG/w depressor 2 is important. The center of gravity of the weight CG/w 30 as seen in FIG. 8, is located vertically beneath the hole 16. However, the center of gravity CG/d of the towline depressor 2 is located below the attaching holes 16 and 18, and substantially half-way between them, or 3 units from the front end 60. As a result, if a towline is attached to the forward most hole 16, the towline depressor will tip upwardly at the front or leading end 60. If attached in the hole 18, it will tip slightly downwardly at the front end 60 and if attached in the rearward most hole 20, it will tip substantially downwardly at the front end 60. Thus, at a high trolling speed hole 16 is used and at a slower speed, the hole 20 is used. But, this towline length determines the depth of troll, regardless of speed.

Figure 7:
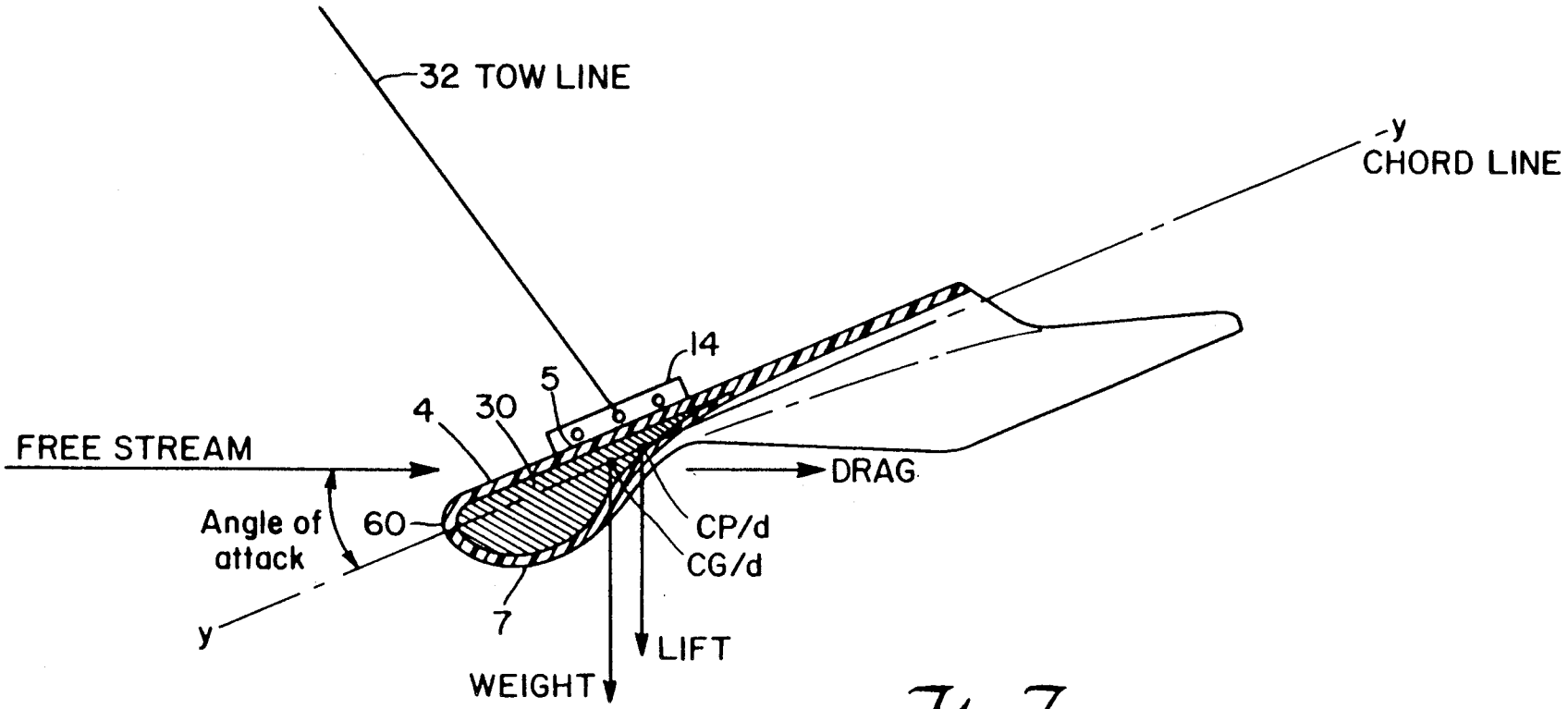
FIG. 7 is a sectional view taken along the line VII—VII on FIG. 2.

The towline depressor or "wing" as it is also called, is shown in Section along its longitudinal axis y in FIG. 7. The forward region or nose portion 4 includes a characteristic airfoil/hydrofoil shape designed to generate lift according to classical theory of lift (e.g., Bernoulli theory). The section shown reduces to a simple flat at 5 along the y axis and is convex as at 7. This area will generate lift (negative) both as described by lifting theory and due to forces applied by the fluid to the surface of the wing.

It is usual to consider the total lift as acting at one theoretical point along the y axis or along the chord line, known as the center of pressure, CP/d. The resultant lift vector (downward) acting at this point is resolved into two components, lift acting normal to the free stream fluid flow and total drag acting in the direction of free stream flow. Total drag is comprised of several components due to the geometry and surface characteristics of the depressor 2, and includes induced drag due to lift. These forces, combined with the forces applied by the towline and the trailing rigging such as a fish line, and due to gravity, combine in a force balance that determines the equilibrium position of the device. FIG. 1 describes the net forces acting on the device at the three axes that are naturally brought into equilibrium in operation.

Lift (negative) increases with the angle of attack (FIG. 7) of the "wing", i.e., the angle between the free stream velocity vector and the chord line of the wing section. By shifting the towline attachment into each successive hole 16, 18 and 20, from front to rear, the angle of attack assumed under load will increase, thereby increasing negative lift or downforce on the towline. This added negative lift is sometimes required to achieve the same depth for increased trailing loads. Alternatively, for a given trailing load, the depth of operation may be selected in this manner. The location of the towline attachment holes 16, 18 and 20 is selected such that an angle of attack is never achieved that would stall the system or allow cavitation due to deparation of water flow from the surface of the wing.

The wing does not include any control mechanisms. In order to assure positive, stable operation without control input, the wing or depressor is designed to provide inherent restoring action in the event of any perturbation from equilibrium conditions. Such perturbation may occur when wing speed changes due to changes in throttle setting, wave motion at the surface, turning accelerations, fish strikes, etc.

The Wing is shown in FIG. 1 illustrating three primary axes of motion X, Y and Z and related displacement planes.

The force balance described above relates primarily to stability in the pitching plane, and to stability in the other planes of motion (yaw and roll). In general, no direct loads are applied in yaw and roll, although water currents and side loads applied by striking fish, for example, can disturb the system in these planes.

As shown in FIG. 7, the main body portion 4, which includes the weight 30 has the weight located in relation to the rest of the system so as to place the system or depressors center of gravity, CG/d, under all loading conditions, ahead of the center of pressure CP/d of the system. Because the theoretical center of pressure CP/d is a function of the co-efficient of lift, it will shift along the chord line with changes in angle of attack. The center of pressure on an object in a liquid is the point where the application of a single support will balance the liquid pressure. The location of the towline attachment is, therefore, limited such that the angle of attack is constrained to an operating range that maintains a condition of longitudinal stability.

The wing is designed to provide positive static longitudinal stability; any displacement of the longitudinal axis y in the pitching plane will alter the force balance such that a net restoring force returns the depressor to a stable equilibrium position. This imposes the condition that the net force due to gravity, resolved at the CG/d, in combination with the force due to lift, resolved at the CP/d, be forward of the point of application of towline force (point of attachment) in all cases, further ensuring longitudinal stability under all loading conditions.

The broad, relatively flat area 5 provided outboard of the lifting section, as an extension of it, and trailing rearward from it, provides a dynamic restoring, pitching moment and damping sufficient to quickly reduce longitudinal dynamic oscillation due to changes in velocity, thereby restoring equilibrium under static stability.

The depressor is designed to provide positive static stability in yaw; any displacement along the normal axis z in the yawing plane will alter the force balance in this plane, such that a net restoring moment returns the wing to a stable equilibrium position. Any vertical surface will contribute to the net restoring moment in this circumstance. This imposes the condition that the net hydrodynamic center of the vertical stabilizer is located sufficiently rearward of the system center of mass so as to ensure longitudinal stability under all loading conditions.

When in yaw, the vertical stabilizers will be at some angle of attack relative to free stream and a lift will result along these surfaces. The position of the stabilizers relative to the center of mass of the system provides a net restoring moment that acts in a direction to restore alignment of the device with free stream. Factors affecting the magnitude of the restoring force dur to the stabilizers include the area, section, aspect ratio and sweep-back.

The wing is designed to provide positive static stability in roll; any displacement of the lateral axis x in the rolling plane will alter the force balance in this plane such that a net restoring moment returns the Wing to a suitable equilibrium position.

The principal contributions to overall lateral stability include dihedral angle $\alpha$ of the wings 6 and 8, the sweep-back of the wings, vertical location of the wings with respect to the body 4 of the wing or depressor, and the keel surface due to the vertical stabilizer and towline attachment place.

The preferred embodiment includes the substantial dihedral angle $\alpha$ of the approximately 23°, as shown in FIG. 5. This contributes significant restoring force as the magnitude of the component of the lift vector that is aligned with gravity is greater for the lower wing than for the upper wing when the device is displaced in roll.

Spanwise flow over the wing or towline depressor 2 will result in a stablizing, rolling moment when the entire unit, which includes the towline attachment fin 14 is above the lifting surface in a negative lift configuration.

A small, stabilizing force will result from loads on the vertical surfaces of the fins 52 and 54 in sideslip.

Directional stability and lateral stability are hydrodynamically coupled. It is desired that the depressor track behind the tow vehicle and not deviate laterally. Because of the coupling between roll and yaw in a hydrodynamic system, lateral stability is of some importance in the normal operation of the device.

I claim:

1. A unitary, one-piece, towline depressor having a forward end and a rearward end, a main body portion at the forward end, a pair of wings extending laterally and downwardly from the body portion, a stabilizing fin depending from each wing and, a towline attaching dorsal fin extending upwardly from a fixed position at the top center of the main body portion, a series of spaced holes in the dorsal fin for selectively attaching a towline; and wherein the hole located nearest to the forward end is in a fixed position forward of the center of gravity of the depressor.

2. A towline depressor according to claim 1, wherein the overall length of the depressor is 13 units of length and the hole nearest the forward end is spaced approximately 2.6 units of length from the forward end.

3. A towline depressor according to claim 1, wherein the overall length of the depressor is 13 units of length and the hole next adjacent to the hole nearest the forward end is spaced approximately 3.25 units of length from the forward end.

4. A towline depressor according to claim 1, wherein the overall length of the depressor is 13 units of length and one of the holes is spaced approximately 4 units of length from the forward end.

5. A towline depressor according to claim 1, wherein its weight is approximately 1750 grams.

6. A unitary, one-piece towline depressor having a forward end and a rearward end, a main body portion at the forward end, a pair of wings extending laterally and downwardly from the body portion, a stabilizing fin depending from each wing and, a towline attaching dorsal fin extending upwardly from a fixed position at the top center of the main body portion, a series of spaced holes in the dorsal fin for selectively attaching a towline; and wherein the center of gravity of the depressor is located in a fixed position rearwardly of the hole nearest to the forward end and forwardly the hole next adjacent to it.

7. A towline depressor according to claim 6, wherein the overall length of the depressor is 13 units of length and the hole nearest the forward end is spaced approximately 2.6 units of length from the forward end.

8. A towline depressor according to claim 6, wherein the overall length of the depressor is 13 units of length, the hole next adjacent to the hole nearest the forward end is spaced approximately 3.25 units of length from the forward end.

9. A towline depressor according to claim 6, wherein the overall length of the depressor is 13 units of length, one of the holes is spaced approximately 4 units of length from the forward end.

10. A towline depressor according to claim 6, wherein its weight is approximately 1750 grams.

11. A unitary, one-piece towline depressor having a forward end and a rearward end, a main body portion at the forward end, a pair of wings extending laterally and downwardly from the body portion, a stabilizing fin depending from each wing and, a towline attaching dorsal fin extending upwardly from a fixed position at the top center of the main body portion, a series of spaced holes in the dorsal fin for selectively attaching a towline; and wherein the center of gravity of the depressor is located in a fixed position closer to the forward end than the theoretical center of pressure.

12. A towline depressor according to claim 11, wherein the overall length of the depressor is 13 units of length, the hole nearest the forward end is spaced approximately 2.6 units of length from the forward end.

13. A towline depressor according to claim 11, wherein the overall length of the depressor is 13 units of length, the hole next adjacent to the hole nearest the forward end is spaced approximately 3.25 units of length from the forward end.

14. A towline depressor according to claim 11, wherein the overall length of the depressor is 13 units of length and one of the holes is spaced approximately 4 units of length from the forward end.

15. A towline depressor according to claim 11, wherein its weight is approximately 1750 grams.

16. A towline depressor according to claim 1, wherein when the overall length of the depressor is 13 units of length, the center of gravity of the depressor is located approximately 2.5 units of length from the forward end.

17. A towline depressor according to claim 6, wherein when the overall length of the depressor is 13 units of length, the center of gravity of the depressor is located approximately 2.5 units of length from the forward end.

18. A towline depressor according to claim 11, wherein when the overall length of the depressor is 13 units of length, the center of gravity of the depressor is located approximately 2.5 units of length from the forward end.

* * * * *